United States Patent [19]

Devaux et al.

[11] Patent Number: 4,928,077

[45] Date of Patent: May 22, 1990

[54] TUNABLE MICROWAVE COUPLER WITH MECHANICALLY ADJUSTABLE CONDUCTORS

[75] Inventors: Francois Devaux, Paris; Norbert Herail, Jouy le Moutier; Denis Lefevre, Paris; Jean-Pierre Lehuede, Aubergenville, all of France

[73] Assignee: Thomson-CSF, Paris, France

[21] Appl. No.: 235,322

[22] Filed: Aug. 23, 1988

[30] Foreign Application Priority Data

Aug. 28, 1987 [FR] France ..... 87 12040

[51] Int. Cl.[5] ..... H01P 5/18

[52] U.S. Cl. ..... 333/111; 333/115

[58] Field of Search ..... 333/109, 111, 113, 114, 333/115, 116, 117, 248

[56] References Cited

U.S. PATENT DOCUMENTS

| | | | |
|---|---|---|---|
| 2,606,974 | 8/1952 | Wheeler | 333/115 |
| 3,195,075 | 7/1965 | Veltrop | 333/111 |
| 3,721,921 | 3/1973 | Lang et al. | 333/109 |
| 4,433,313 | 2/1984 | Saint et al. | 333/109 |
| 4,675,623 | 6/1987 | Nowak et al. | 333/26 |

FOREIGN PATENT DOCUMENTS

| | | | |
|---|---|---|---|
| 444270 | 4/1975 | U.S.S.R. | 333/113 |

*Primary Examiner*—Eugene R. Laroche
*Assistant Examiner*—Benny T. Lee
*Attorney, Agent, or Firm*—Roland Plottel

[57] ABSTRACT

Disclosed is a three-plate type coupler providing for the partial tapping, by means of plungers, of a microwave energy which is propagated in a guide. The coupler has mechanical means to vary the height of the central conductor of the three-plate structure at the level at which the plungers are fixed, thus causing a variation in the penetration of the plungers in the waveguide and, consequently, a variation in the coupling.

3 Claims, 2 Drawing Sheets

TUNABLE MICROWAVE COUPLER WITH MECHANICALLY ADJUSTABLE CONDUCTORS

BACKGROUND OF THE INVENTION

1. Field of the Invention

The present invention concerns a coupler that provides for a partial tapping of microwave energy propagated in a waveguide towards a microwave circuit. More precisely, it concerns a three-plate type of coupler comprising plungers that penetrate the guide.

2. Description of the Prior Art

In certain applications, it is necessary to tune the coupling between the guide and the microwave circuit very precisely at a pre-defined value. An application of this type is, for example, an electronic scanning antenna where there is a series of couplers supplying, from a common guide, a series of phase shifters which themselves supply the radiating elements. The radiation pattern desired for the antenna entails very precise coupling for each coupler. Since the coupling is given by the mechanical length of the plungers in the guide, the requirement of precision in the coupling implies a requirement of manufacturing precision for all the parts coming into play.

In practice, the manufacturing tolerances are such that the radiation pattern obtained is rarely satisfactory. Hence, after the antenna is mounted, tests and measurements are conducted to prepare corrected values for the length of the plungers. Then the couplers are dismantled, the plungers are replaced and then the couplers are re-mounted. The need for these various operations obviously entails disadvantages, especially as regards manufacturing time and costs, all the more so as the number of couplers is large. Furthermore, the operations for dismantling and re-mounting the coupler may cause the mechanical deformation of certain parts and may, consequently, introduce additional errors.

An object of the present invention is a coupler of this type which can be tuned without dismantling, thus avoiding the above disadvantages. To this end, the coupler has external means for the variation of the height of the central conductor of the three-plate structure at the level at which the plungers are fixed, thus causing a variation in the penetration of the plungers into the guide, and consequently, a variation in coupling.

SUMMARY OF THE INVENTION

More precisely, an object of the invention is a three-plate type microwave coupler having a central conductor placed between two conducting plates forming ground plates, and at least one conducting plunger, fixed to the central conductor and designed to penetrate into a microwave waveguide. The coupler also has externally controllable means to vary the distance between the central conductor and the ground plates in the region of the plunger.

BRIEF DESCRIPTION OF THE DRAWINGS

Other objects, special features and results of the invention will emerge from the following description, illustrated by the appended drawings, of which.

FIGS. *3a* and *3b* show another embodiment of the coupler according to the invention.

In these different figures, the same references pertain to the same elements.

DESCRIPTION OF PREFERRED EMBODIMENTS

Figure 1:
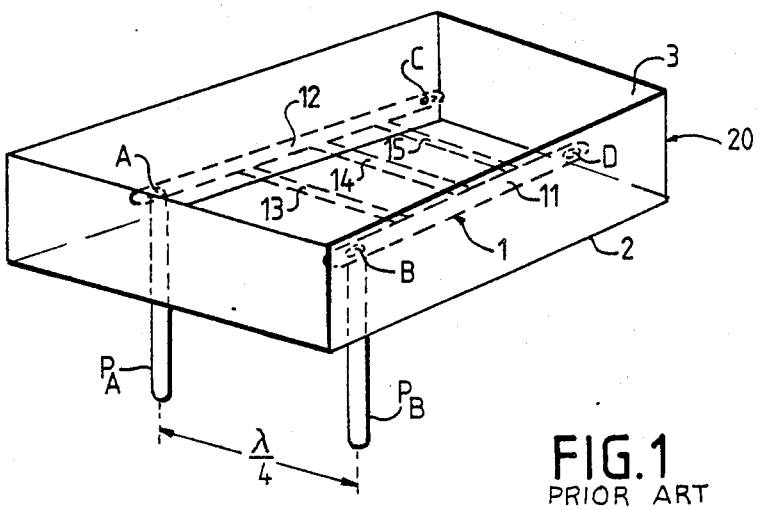
FIG.1 PRIOR ART
FIG. 1 shows a view of a prior art coupler.

FIG. 1 thus shows a known coupler of the ladder-shaped 3 dB type, made with three-plate technology.

This coupler has a central conductor, with a general reference 1, located between two conducting plates 2 and 3 forming ground plates. The central conductor 1 has a general ladder shape: it has two substantially parallel conductors 11 and 12, connected by three conductors 13, 14, 15 which are substantially parallel to one other and perpendicular to the preceding conductors. The ends A and C of the conductor 12 and B and D of the conductor 11 form the input/output terminals of the coupler. Connected to the terminals A and B are two metallic rods forming plungers, $P_A$ and $P_B$ respectively, which are substantially perpendicular to the plane of the central conductor 1. The conductors 11 and 12 are substantially at a distance of $\lambda/4$ from each other, $\lambda$ being the wavelength of the microwave energy propagated in the guide where the energy is tapped.

The ground plates 2 and 3 are, for example, connected to each other by conducting lateral walls, thus forming a case with a general reference 20.

As indicated above, a coupler of this type can be used, for example, in an electronic scanning antenna. The plungers $P_A$ and $P_B$ then penetrate, along a height h, (see FIG. 2) into a microwave energy supplying waveguide. At transmission, for example, the energy tapped by these plungers, which depends on the height h, is then available at one of the terminals C or D, intended for a phase shifter which itself supplies one of the radiating elements of the antenna, the other terminal being insulated. The connection is done, for example, by means of coaxial conductors.

Figure 2:
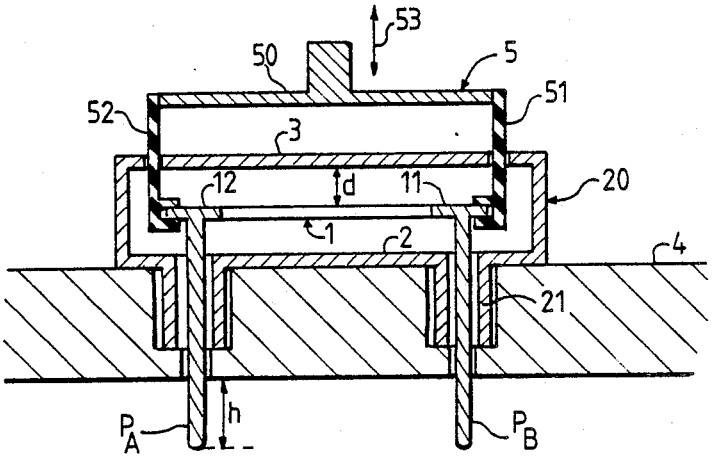
FIG. 2 shows a sectional view of an embodiment of the coupler according to the invention.

FIG. 2 shows a sectional view, at the level of the plungers, of an embodiment of the coupler according to the invention.

This figure thus again shows the central conductor 1 extended by the plungers, $P_A$ and $P_B$, and the case 20, which includes the ground plate 2, and which is extended by sleeves 21 around plungers $P_A$ and $P_B$. This sectional view further shows the wall 4 of a waveguide which receives the sleeves 21 and into which the plungers $P_A$ and $P_B$ penetrate, going beyond the guide by a height h.

According to the invention, on the conductors 11 and 12 of the central conductor 1, at the level of the plungers $P_A$ and $P_B$, there are mechanical means 5 to cause variation in the height of the central conductor, namely the distance d separating it from one of the ground plates, for example 3. The means 5 are formed so that the insulating rods 51 and 52 enclose the conductors 11 and 12, preferably in the region of the plungers, as shown in the figure. These rods emerge from the outside of the case 20 and are connected by mechanical means 50 which enable them to give a vertical motion (arrow 53), so that the distance d can be made to vary by the deformation of the conductor 1.

It would thus appear that the means 50, external to the coupler, make it possible to vary the position of the central conductor 1 vertically: the position of the plungers $P_A$ and $P_B$, which are solidly joined to this conductor, vary similarly, thus causing variation in the height h of the penetration of the plungers into the guide.

The coupling made by the coupler can thus be tuned externally.

Figure 3A:
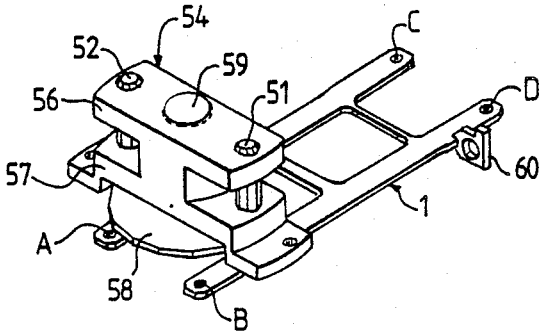
Figure 3B:
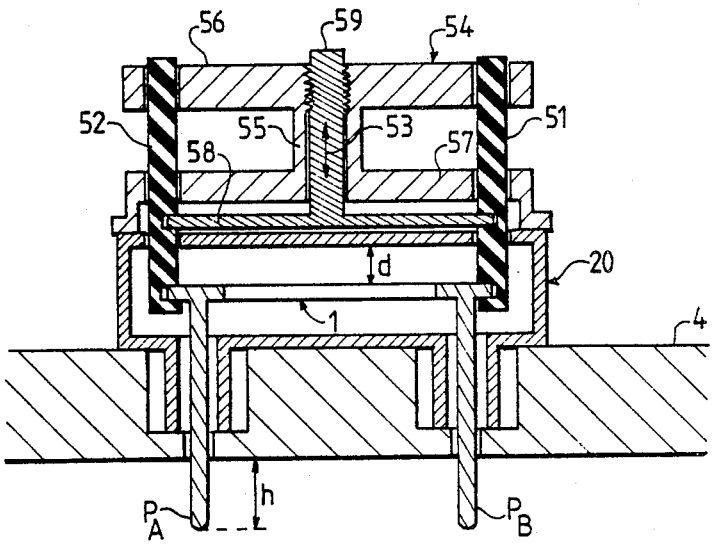

FIGS. 3*a* and 3*b* represent another embodiment of the device according to the invention, respectively seen in partial perspective and in a sectional view at the level of the plungers.

FIG. 3*a* thus shows only the means for adjusting the distance d gripping the central conductor 1. This figure shall be described below in relation to FIG. 3*b*.

The sectional view of FIG. 3*b* again shows the case 20, the wall 4 of the guide, and the central conductor 1 of FIG. 2 as well as the rods 51 and 52.

The rods 51 and 52 are movable in a broadly I-shaped structure marked 54. The lower part 57 of the I is fixed to the case 20. The rods 51 and 52 go through the two parts, namely the lower part 57 and the upper part 56 of the I-shaped structure, which thus provides for the guiding of the rods. The rods are movable through a part 58 that extends beyond the I-shaped structure 54 and is, for example, substantially disk-shaped and provided with a central shaft 59 going through the central part 55 of the I-shaped structure. At least one part of the facing surfaces of the parts 55 and 59 is threaded. The rods 51 and 52 grip the parts 1 and 58, for example, by means of notches.

The device works as follows: the rotation of the disk 58 enables, through the shaft 59 and its thread, to communicate the preceding vertical motion 53 to the disk 58 and, consequently, to the rods 51 and 52 and to the central conductor 1, thus causing variation in the distance d at the plungers and, consequently, in the height h.

FIG. 3*a* further shows, by way of example, one of the fixed holding parts 60 of the central conductor 1 in the case 20 at the terminal D. Another part of this type is placed at the level of the terminal C. In this embodiment, the variation in the distance d at the level of the plungers is thus obtained by the flexure of the central conductor.

The above description of the invention has been given, of course, as a non-restrictive example. It is thus that, especially, the variation in the height of the central conductor at the plungers has been described as taking place through deformation of the central conductor, but it can also take place through translation of this conductor. Again, it is thus that the three-plate coupler described is of the standard ladder-shaped 3 dB coupler type but it can also be of another type and, again, it is shown as comprising two plungers, but the invention applies to a coupler comprising any number of plungers. Thus, yet again, the means 5 have been described as gripping the conductors 11 and 12 of the central conductor, preferably at the level of the plungers. But they can, of course, grip it at another part, the conductor 13 for example.

What is claimed is:

1. A microwave coupler of the three-plate type comprising a ladder-shaped central conductor (1) placed between two conducting plates (2,3) forming ground plates, said central conductor having two substantially parallel conductors (11,12) connected by conductors (13,14,15) which are substantially perpendicular to said parallel conductors, said parallel conductors (11,12) having opposite ends which form the terminals of said coupler, two conducting plungers ($P_A$, $P_B$) respectively fixed to two predetermined parts (A,B) of said parallel conductors (11,12) and designed to penetrate a microwave waveguide (4), said plungers being aligned along a direction of propagation of waves within said waveguide, externally controllable means for varying (51–59) the distance between said predetermined parts (A,B) and said ground plates through a flexure of said central conductor (1), thus varying the length by which said plungers ($P_A$, $P_B$) penetrate into said waveguide (4), said means for varying comprising at least one rod (51) rigidly mechanically coupled to and electrically insulated from said predetermined parts (A,B) with mechanical translation of said rod providing for variation of said distance.

2. A coupler according to claim 1, wherein said means for varying comprises two electrically insulated rods (51,52) fixed to said predetermined parts (A,B) respectively, said rods extending outside one of said ground plates (13) and being connected to mechanical means (53–59) for translating said rods.

3. A coupler according to claim 2, wherein said mechanical means comprises a structure (54–57) fixed to one of said ground plates (3) in which said rods (51, 52) are movable and guided, and a part (59) extending beyond and connected by a thread to said structure, said part being interlocked but movable in rotation in relation to said two rods, rotation of said part (59) communicating a translational motion to said rods with respect to said structure and, consequently with respect to said ground plate.

* * * * *